US007686568B2

(12) United States Patent
Moors et al.

(10) Patent No.: US 7,686,568 B2
(45) Date of Patent: Mar. 30, 2010

(54) METHODS AND APPARATUS FOR FABRICATING TURBINE ENGINES

(75) Inventors: Thomas Michael Moors, Woodruff, SC (US); David Scott Williams, Seneca, SC (US)

(73) Assignee: General Electric Company, Schenectady, NY (US)

( * ) Notice: Subject to any disclaimer, the term of this patent is extended or adjusted under 35 U.S.C. 154(b) by 837 days.

(21) Appl. No.: 11/534,434

(22) Filed: Sep. 22, 2006

(65) Prior Publication Data

US 2008/0075600 A1 Mar. 27, 2008

(51) Int. Cl.
*F01D 5/20* (2006.01)

(52) U.S. Cl. ..... 415/1; 415/173.4; 415/173.6; 415/174.4; 416/224

(58) Field of Classification Search ..... 415/173.1, 415/173.4, 173.5, 173.6, 174.4, 174.5, 1; 416/2, 190, 191, 192, 224
See application file for complete search history.

(56) References Cited

U.S. PATENT DOCUMENTS 4,390,320 A * 6/1983 Eiswerth ..... 416/97 R
5,785,496 A 7/1998 Tomita
6,241,471 B1 6/2001 Herron
6,506,022 B2 1/2003 Bunker
6,547,522 B2 * 4/2003 Turnquist et al. ..... 415/173.3
6,805,530 B1 * 10/2004 Urban ..... 415/173.4
6,851,931 B1 * 2/2005 Tomberg ..... 416/189
6,890,150 B2 * 5/2005 Tomberg ..... 415/173.4
6,893,216 B2 * 5/2005 Snook et al. ..... 415/173.1
6,913,445 B1 * 7/2005 Beddard et al. ..... 416/192
7,001,144 B2 * 2/2006 Urban et al. ..... 415/173.1
7,094,032 B2 * 8/2006 Seleski ..... 416/192
7,104,762 B2 9/2006 Dausacker et al.
7,255,531 B2 * 8/2007 Ingistov ..... 415/173.1
7,273,353 B2 * 9/2007 Dube et al. ..... 416/192
2004/0170500 A1 * 9/2004 Urban et al. ..... 416/179
2004/0208743 A1 * 10/2004 Urban ..... 415/173.4
2004/0223849 A1 * 11/2004 Urban ..... 416/223 A
2005/0036886 A1 * 2/2005 Tomberg ..... 415/173.4
2005/0129519 A1 * 6/2005 Beddard et al. ..... 416/192
2005/0186079 A1 * 8/2005 Ingistov ..... 416/223 R
2005/0191182 A1 * 9/2005 Seleski ..... 416/192
2008/0145207 A1 * 6/2008 Mohr et al. ..... 415/173.1
2008/0292466 A1 * 11/2008 Tragesser et al. ..... 416/223 R

* cited by examiner

*Primary Examiner*—Edward Look
*Assistant Examiner*—Aaron R Eastman
(74) *Attorney, Agent, or Firm*—Armstrong Teasdale LLP

(57) ABSTRACT

A method for fabricating a turbine bucket and an apparatus facilitate reducing tip shroud creep. The method includes providing a turbine bucket that includes a tip shroud including at least one seal rail. The method also includes coupling at least one cutter tooth to the tip shroud, wherein the at least one cutter tooth is fabricated from an abradable material that enables the at least one cutter tooth to be removed from the tip shroud during operation of the turbine engine.

20 Claims, 3 Drawing Sheets

METHODS AND APPARATUS FOR FABRICATING TURBINE ENGINES

BACKGROUND OF THE INVENTION

This invention relates generally to turbine engines and, more particularly, to methods and apparatus for constructing turbine bucket cutter teeth.

At least some known turbine engines include at least one stator assembly and at least one rotor assembly that includes at least one row of circumferentially-spaced turbine blades or buckets. The blades extend radially outward from a platform to a tip. A plurality of static shrouds coupled within the stator assembly abut together to define a flow path that extends substantially circumferentially around the rotor assembly. A seal may be provided at the tip of the buckets to facilitate enhancing turbine efficiency and performance.

At least some known rotor assemblies include a tip shroud formed on the outboard end of each bucket. Known tip shrouds each include a shelf and a sealing rail. A honeycomb structure may surround the tip shroud, and in such embodiments, the sealing rail may include one or more cutter teeth that cut through some of the honeycomb material to establish a tip clearance. Minimizing tip clearances facilitates improving turbine performance, but the tip clearance must still be sized large enough to facilitate rub-free engine operation through the range of available engine operating conditions.

Known tip shroud areas, may be vulnerable to creep damage arising when the cutter tooth mass is exposed to high operating temperatures and rotational stresses that may be present during engine operation. To facilitate reducing creep issues, at least some turbine assemblies, centrally locate cutter teeth relative to each bucket. However, because the cutter teeth serve no purpose after the honeycomb structures have been cut through and the tip clearances established, it would be advantageous if the cutter teeth could be removed after the initial hours of operation of the engine. However, with known rotor assemblies, to remove the cutter teeth, the engine would have to be shut down and the rotor assembly removed to enable a user to remove the cutter teeth from the engines.

BRIEF DESCRIPTION OF THE INVENTION

In one aspect, a method for fabricating in a turbine bucket to facilitate reducing tip shroud creep is provided. The method includes providing a turbine bucket that includes a tip shroud including at least one seal rail. The method also includes coupling at least one cutter tooth to the tip shroud, wherein the at least one cutter tooth is fabricated from a consumable material that enables the at least one cutter tooth to be removed from the tip shroud during operation of the turbine engine.

In another aspect, an airfoil bucket for a gas turbine engine is provided. The bucket includes a tip shroud extruding from the airfoil and at least one cutter tooth extending from the tip shroud. The cutter tooth is fabricated from a material that is configured to wear away during operation of the gas turbine engine.

DETAILED DESCRIPTION OF THE INVENTION

Figure 1:
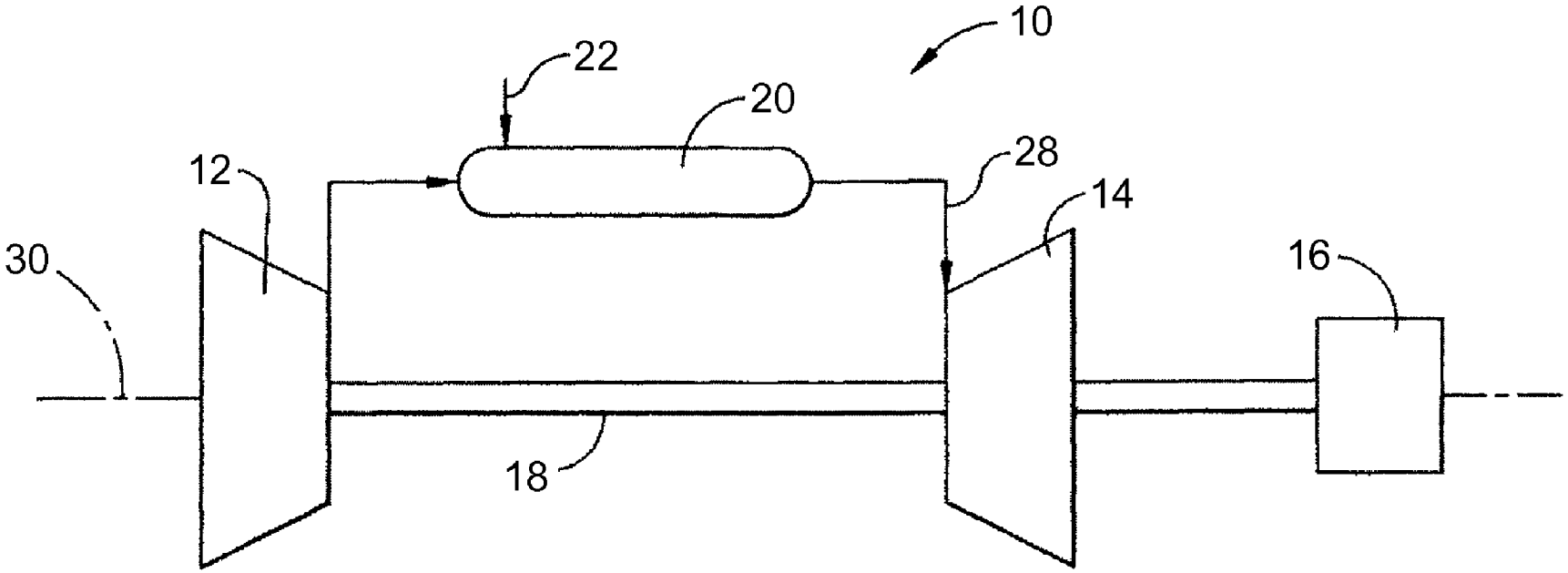
FIG. 1 is a schematic illustration of an exemplary turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single rotor or shaft 18. In an alternative embodiment, shaft 18 is segmented into a plurality of shaft segments, wherein each shaft segment is coupled to an adjacent shaft segment to form rotor shaft 18. Compressor 12 supplies compressed air to a combustor 20 wherein the air is mixed with fuel supplied via a stream 22.

In operation, air flows through compressor 12 and compressed air is supplied to combustor 20. Combustion gases 28 from combustor 20 propel turbine 14. Turbine 14 rotates rotor shaft 18, compressor 12, and electric generator 16 about a longitudinal axis 30.

Figure 2:
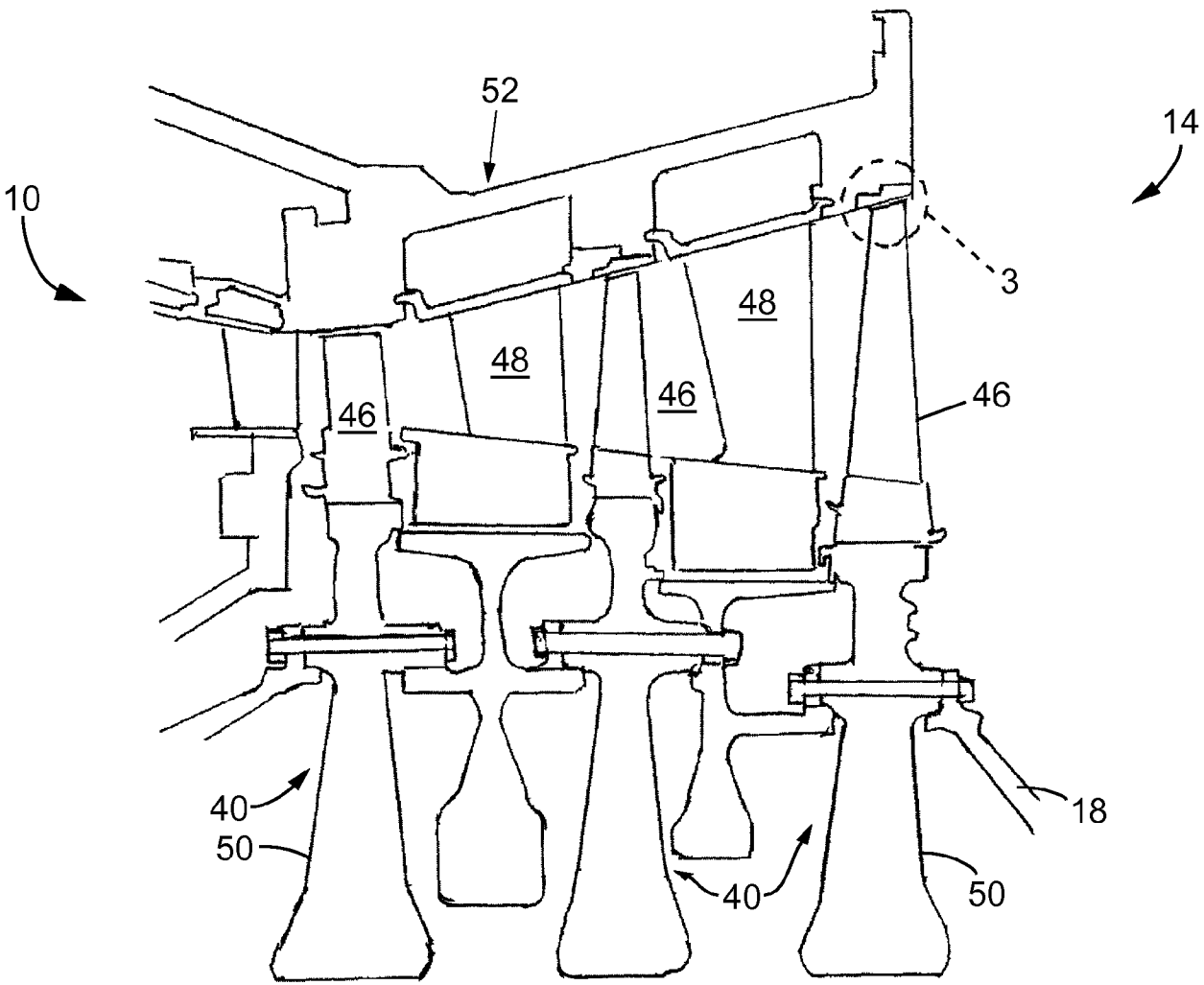
FIG. 2 is a schematic illustration of a portion of an exemplary high pressure turbine that may be used with the turbine engine shown in FIG. 1.

FIG. 2 is a schematic illustration of a portion of a high pressure turbine, such as turbine 14, that may be used with turbine engine 10. Turbine 14 includes a plurality of stages 40 which each include a rotating row of turbine blades or buckets 46 and a stationary row of stator vanes 48. Turbine buckets 46 are supported by rotor disks 50 coupled to a rotor shaft, such as rotor shaft 18. A turbine casing 52 extends circumferentially around turbine buckets 46 and stator vanes 48, such that stator vanes 48 are supported by casing 52.

Figure 3:
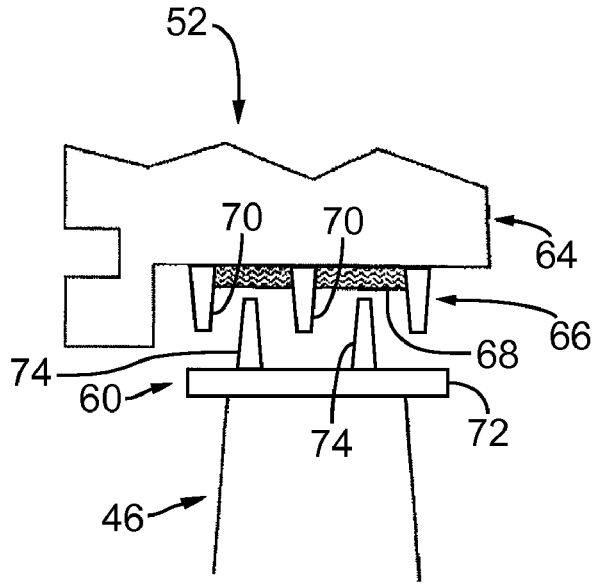
FIG. 3 is an enlarged schematic illustration of a portion of the high pressure turbine shown in FIG. 2 and taken along area 3.

FIG. 3 is an enlarged portion of turbine 14 shown in FIG. 2 and taken along area 3. Specifically, FIG. 3 illustrates an exemplary tip shroud 60 positioned radially outward from a turbine bucket 46. A plurality of case shroud segments 64 are coupled to casing 52 such that each segment 64 is radially outward from a row of turbine blades 46 within a respective turbine stage 40. In the exemplary embodiment, each shroud segment 64 includes a honeycomb seal insert 66 including a honeycomb seal material 68. Honeycomb seal insert 66 facilitates reducing gas leakage between bucket tip shroud 60 and case shroud segment 64. Moreover, honeycomb seal insert 66 facilitates enhancing the rub tolerance between bucket tip shroud 60 and case shroud segment 64. In the exemplary embodiment, shroud case segment 64 also includes seal rails 70 that also facilitate reducing gas leakage between case shroud segment 64 and bucket tip shroud 60.

Turbine bucket tip shroud 60 includes a platform 72 having seal rails 74 formed thereon. Seal rails 74 engage honeycomb seal insert 66 to cut or groove the honeycomb material 68 such that a desired clearance is defined between bucket tip shroud 60 and case shroud segment 64. Although turbine bucket tip shroud 60 shown in FIG. 3 including only two seal rails 74, it should be understood turbine tip shroud 60 may be fabricated with more or less than two seal rails 74. Similarly, case shroud segment 64 may be fabricated with any number of radially seal rails 70. For example, in one embodiment, case shroud segment 64 does not include any seal rails 70.

Figure 4:
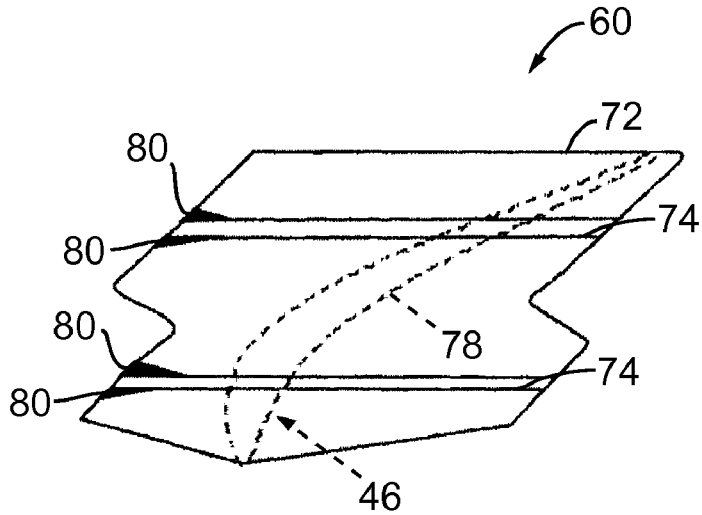
FIG. 4 is a schematic top plan view of an exemplary turbine tip shroud shown in FIG. 3.

FIG. 4 is a schematic top plan view of turbine bucket tip shroud 60. Turbine bucket 46 includes an airfoil 78 (shown in phantom outline). Turbine bucket tip shroud 60 is formed at a tip of airfoil 78. To facilitate cutting or grooving honeycomb material 68 (shown in FIG. 3), seal rails 74 are provided with cutter teeth 80. In an exemplary embodiment, at least one cutter tooth 80 is provided on each side of seal rail 74. Cutter teeth 80 create grooves within honeycomb material 68 during operation of engine 10. Cutter teeth 80 may be provided on one or more stages 40 of turbine 14 (shown in FIG. 2). In the exemplary embodiment, cutter teeth 80 are provided on at least one of the last stages 40 of turbine 14.

In the exemplary embodiment of the invention, cutter teeth 80 are fabricated to be sacrificial cutter teeth. More specifically, cutter teeth 80 are temporary cutter teeth that are fabricated from a material designed to erode or corrode in the hot gas environment of turbine bucket 46. Optionally, cutter teeth 80 may be fabricated from a material that is designed to liberate after the initial hours of engine operation without causing damage to downstream gas path components. For example, in one embodiment, cutter teeth 80 may be fabricated from a corrosion susceptible ferrous material. Alternatively, cutter teeth 80 may be fabricated from a low chromium nickel alloy. Cutter teeth 80 may also be fabricated from a material such as a cold-rolled steel material that is susceptible to corrosion, but is strong enough to last long enough to groove honeycomb material 68. Cutter teeth 80 may be fabricated using a variety of known fabrication methods including laser cutting processes or water jet processes. Alternatively, cutter teeth 80 may be stamped using a progressive die process. After fabrication, cutter teeth 80 may be coated with an oil or other preservative to inhibit premature corrosion. In one embodiment, cutter teeth 80 may be coupled to seal rails 74 via spot welding. Alternatively, cutter teeth 80 may be attached to seal rails 74 by brazing or any other known coupling process. In another embodiment, the cutter teeth 80 are thermally sprayed to the seal rails 74. Because cutter teeth 80 are temporary, or become insignificant, cutter teeth 80 do not require machining to be removed from tip shroud 60.

In the exemplary embodiment, cutter teeth 80 are positioned proximate an outer end of seal rails 74. However, it is to be understood that cutter teeth 80 may be positioned at any point along seal rails 74. The temporary nature of cutter teeth 80 eliminates the need to strategically locate the cutter tooth mass. Moreover, with cutter teeth 80, tip shroud 60 is not exposed to a substantial increase in creep. Additionally, the temporary nature of cutter teeth 80 facilitates reducing turbulence in the gas flow path, as compared to cutter teeth that are prematurely mounted.

The above-described apparatus provides a cutter tooth that can be located anywhere along the seal rail without generating substantial creep issues. The cutter teeth form desired grooves in the honeycomb shroud during the initial hours of operation of the engine and are worn away or corrode away to become insignificant with continued engine operation. Optionally, the cutter tooth may be removed without extensive unit down time or excessive cost. The cutter tooth design facilitates improving maintainability of the turbine assembly and improving the operating efficiency of the gas turbine engine in a cost-effective and reliable manner.

Exemplary embodiments of cutter teeth for grooving a honeycomb shroud in a turbine engine are described above in detail. The apparatus is not limited to the specific embodiments described herein, but rather, the cutter teeth may be utilized independently and separately from other components described herein. For example, the cutter teeth may be applied to existing non-cutter tooth buckets without requiring casting tool changes. As such, honeycomb shrouds may be used in engines that do not currently use this technology. Moreover, cutter teeth may be scaled appropriately for different sized buckets.

While the invention has been described in terms of various specific embodiments, those skilled in the art will recognize that the invention can be practiced with modification within the spirit and scope of the claims.

What is claimed is:

1. A method for fabricating a turbine bucket, said method comprising:

providing a turbine bucket including a tip shroud including at least one seal rail; and coupling at least one cutter tooth to the tip shroud, wherein the at least one cutter tooth is fabricated from an abradable material that enables the at least one cutter tooth to be removed from the tip shroud during operation of the turbine engine as the at least one cutter tooth establishes a tip clearance within a portion of a turbine bucket seal.

2. A method in accordance with claim 1 wherein coupling at least one cutter tooth to the tip shroud further comprises coupling at least one cutter tooth to the tip shroud that erodes during turbine operation.

3. A method in accordance with claim 1 wherein coupling at least one cutter tooth to the tip shroud further comprises coupling at least one cutter tooth to the tip shroud that is fabricated from a material that corrodes during turbine operation.

4. A method in accordance with claim 1 wherein coupling at least one cutter tooth to the tip shroud further comprises coupling at least one cutter tooth to the tip shroud that is fabricated from a material that is liberated during turbine operation without causing damage to downstream gas path components.

5. A method in accordance with claim 1 wherein coupling at least one cutter tooth to the tip shroud further comprises coupling at least one cutter tooth to the tip shroud that is fabricated from a ferrous material.

6. A method in accordance with claim 5 further comprising coating the at least one cutter tooth with oil to facilitate preventing premature corrosion.

7. A method in accordance with claim 1 wherein coupling at least one cutter tooth to the tip shroud further comprises coupling at least one cutter tooth to the tip shroud that is fabricated from a chromium nickel alloy.

8. A method in accordance with claim 1 wherein coupling at least one cutter tooth to the tip shroud further comprises coupling at least one cutter tooth to the tip shroud to facilitate reducing tip shroud creep during operation of the turbine engine.

9. A method in accordance with claim 1 wherein coupling at least one cutter tooth to the tip shroud further comprises coupling at least one cutter tooth to the tip shroud via one of a brazing process and a welding process.

10. A method in accordance with claim 1 further comprising fabricating the at least one cutter tooth via a laser cutting process.

11. A method in accordance with claim 1 further comprising fabricating the at least one cutter tooth via a water jet process.

12. A method in accordance with claim 1 further comprising fabricating the cutter tooth using a progressive stamping process.

13. An airfoil bucket for a turbine engine, said bucket comprising:

a tip shroud extending from said airfoil; and at least one cutter tooth extending from said tip shroud, said at least one cutter tooth is fabricated from a material configured to wear away during operation of the turbine engine as a tip clearance is established within a portion of a bucket seal by said at least one cutter tooth.

14. A bucket in accordance with claim 13 wherein said at least one cutter tooth is fabricated from a ferrous material.

15. A bucket in accordance with claim 13 wherein said at least one cutter tooth is fabricated from a chromium nickel alloy.

16. A bucket in accordance with claim 13 wherein said at least one cutter tooth is fabricated from cold-rolled steel.

17. A bucket in accordance with claim 13 wherein said at least one cutter tooth is spot-welded to said tip shroud.

18. A bucket in accordance with claim 13 wherein said at least one cutter tooth is brazed to said tip shroud.

19. A bucket in accordance with claim 13 further comprising at least one seal rail extending from said tip shroud.

20. A bucket in accordance with claim 13 further comprising a coating extending over said at least one cutter tooth.

* * * * *